United States Patent [19]

Beauvais

[11] Patent Number: 4,489,251

[45] Date of Patent: Dec. 18, 1984

[54] MICROCHANNEL IMAGE INTENSIFIER TUBE AND IMAGE PICK-UP SYSTEM COMPRISING A TUBE OF THIS TYPE

[75] Inventor: Yves Beauvais, Paris, France

[73] Assignee: Thomson-CSF, Paris, France

[21] Appl. No.: 281,294

[22] Filed: Jul. 7, 1981

[30] Foreign Application Priority Data

Jul. 11, 1980 [FR] France ..... 80 15496

[51] Int. Cl.[3] ..... H01J 43/04; H01J 43/28

[52] U.S. Cl. ..... 313/105 CM; 313/534; 313/553; 313/558

[58] Field of Search ..... 313/95, 103 R, 103 CM, 313/106, 105 CM, 481, 102, 528, 534, 558, 559, 560, 553; 250/213 VT

[56] References Cited

U.S. PATENT DOCUMENTS

| | | | |
|---|---|---|---|
| 2,880,348 | 3/1959 | Gray | 313/481 |
| 3,100,274 | 8/1963 | Luftman et al. | 313/481 |
| 3,816,788 | 6/1974 | Reash | 313/481 |
| 3,868,536 | 2/1975 | Enck, Jr. | 313/95 |
| 3,870,917 | 3/1975 | Cuny | 313/105 R |
| 4,295,073 | 10/1981 | Freeman et al. | 313/534 X |

*Primary Examiner*—David K. Moore
*Assistant Examiner*—K. Wieder
*Attorney, Agent, or Firm*—Roland Plottel

[57] ABSTRACT

In order to limit the increased quantity of ions produced within the tube as a result of the presence of a microchannel element within the tube, getters are placed on the probable path followed by the ions under the action of potentials applied to the electrodes. The electrodes to which the getters adhere are designed in two parts or constituent elements in order to permit the supply of getters if necessary. The electrode elements are bent-back in order to serve as shields in the case of vaporizable getters.

10 Claims, 4 Drawing Figures

MICROCHANNEL IMAGE INTENSIFIER TUBE AND IMAGE PICK-UP SYSTEM COMPRISING A TUBE OF THIS TYPE

This invention relates to an image intensifier tube comprising a microchannel element.

An element of this type is constituted by a large number of juxtaposed channels of very small diameter, said channels being formed in a plate having a high coefficient of secondary emission and low electrical conductivity. When a voltage of a few hundred volts is applied between the ends of the channels, each electron which enters one of the channels causes emission of secondary electrons by impact on the channel wall, whereupon said electrons generate further secondary electrons and so on, the result being a gain of electrons which may commonly attain values of $10^4$ to $10^5$.

One of the problems arising from the introduction of microchannel plates in image intensifier tubes and vacuum tubes in general lies in the considerable release of gas from the plate material, especially under the action of electron bombardment. The gases released are readily ionized by the electrons; the ions thus formed are accelerated towards the low-potential regions of the tube and especially the photocathode in the case of image intensifiers. The ionic erosion of the photocathode then results in progressive destruction of this latter and consequently reduces the service life of the tube. Furthermore, the emission of electrons by the photocathode continuously decreases in the course of time, thereby removing all operational stability of the tube.

The aim of the invention is to improve this stability and to lengthen the service life of the tube.

Other features of the invention will be more apparent upon consideration of the following description and accompanying drawings, wherein.

Figures 3A, 3B:
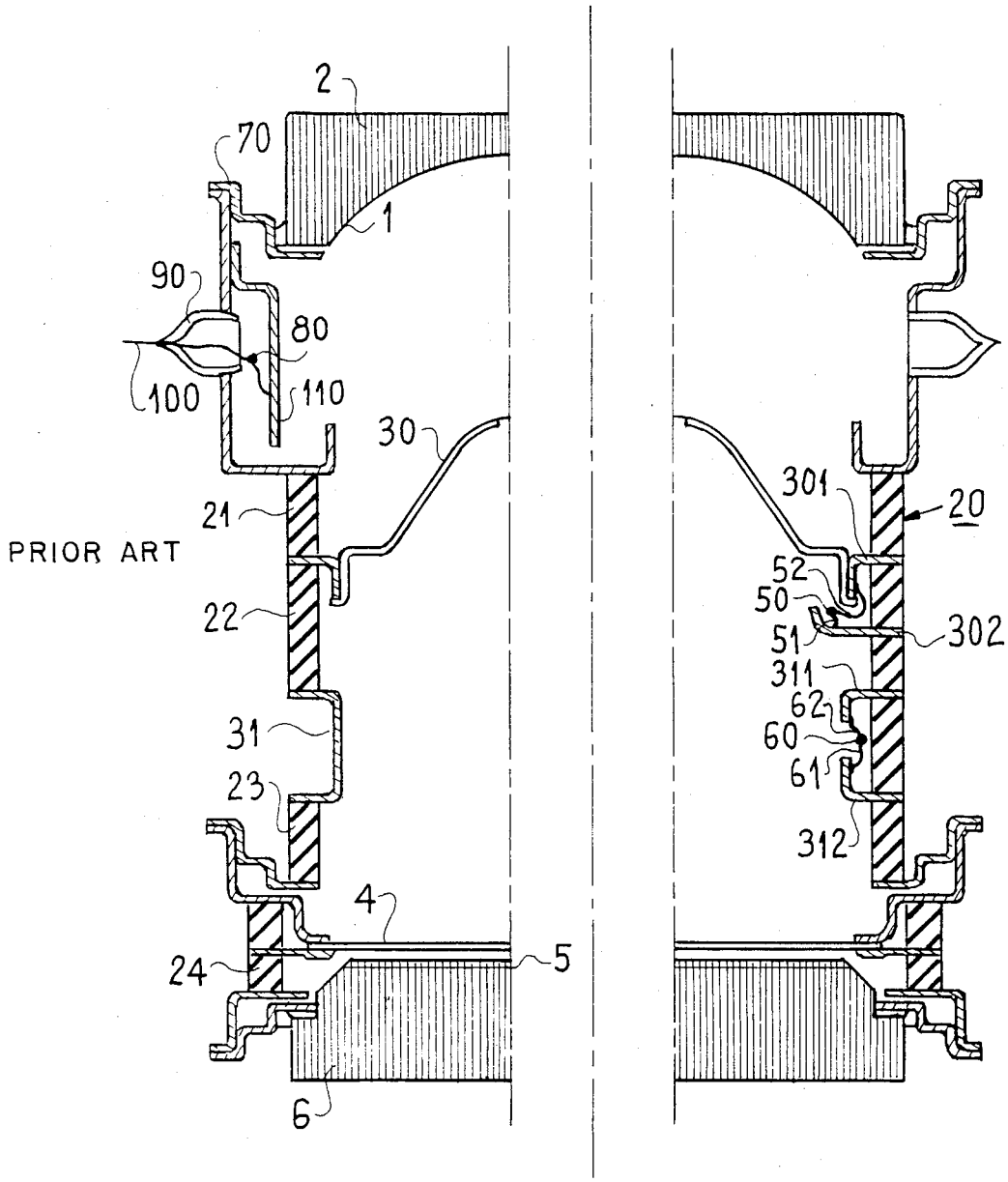

FIGS. 3*a* and 3*b* are compared views of embodiments of an image intensifier in accordance with the prior art (FIG. 3*a*) and in accordance with the present invention (FIG. *b*).

The general structure of a microchannel image intensifier of a type which is already known in the prior art will first be recalled. This structure is illustrated in FIG. 1 in the case of a cylindrical tube having an axis X'-X.

An intensifier of this type comprises:

- a photoemissive layer or photocathode 1 incorporated in an entrance window 2; during operation, the photocathode receives the incident radiation represented by the wavy arrow and emits at each point a number of electrons which is proportional to the incident flux received by said point;
- an electrostatic or electromagnetic electron-optical device 3;
- a microchannel plate 4;
- a cathodoluminescent screen 5 forming an integral part of an exit window 6.

Figure 1:
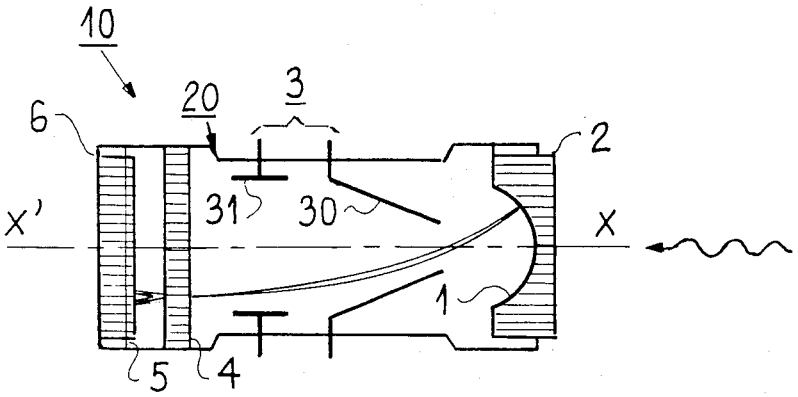
FIG. 1 PRIOR ART
FIG. 1 is a general schematic view of a microchannel image intensifier tube of a type which is already in use in the prior art.

The electron-optical unit produces acceleration and transfer of the electrons emitted by each point of the photocathode to a corresponding point of the microchannel plate 4; this electron transfer is accompanied by an image inversion as represented in FIG. 1 by the narrow electron beam (curved lines without any reference) which corresponds to one of the points.

The electron-optical device is composed of a plurality of electrodes, the two main electrodes being shown in FIG. 1, namely the focusing electrode and the correcting electrode; these electrodes are designated by the reference numerals 30 and 31 respectively.

At the exit of each channel, the secondary electrons are accelerated and focused to the different points of the luminescent screen by an electric field established between the microchannel plate 4 and the screen 5; the cone of impact of the electrons of one channel on the screen is shown in FIG. 1 but not designated by a reference. For the sake of enhanced clarity, the vertex angle of the cone has been purposely exaggerated in FIG. 1. These impacts form on the screen a luminous image which corresponds to the incident image.

The assembly constituted by the elements described in the foregoing forms the image intensifier tube 10, the vacuum envelope of which is designated by the reference numeral 20.

The accompanying drawings do not illustrate either the entrance window structure or the exit window structure but do show the presence of the photocathode in the entrance window and of the luminescent screen in the exit window (the path of the electrons produced by the photocathode, or photoelectrons, being located between said windows) since it will only be necessary to describe these two elements in order to gain a clear understanding of the invention. Said windows may comprise other elements such as optical fiber plates or scintillators in the case of incident radiations outside the visible spectrum in accordance with known practice in the prior art.

Similarly, the voltage sources employed during operation have purposely been omitted from the drawings for the sake of simplification. However, the distribution of potentials within a tube of this type will be specified in one example given below.

A high-luminance image can be obtained on the exit screen of a tube of this type, on the one hand by virtue of the energy imparted to the electrons by the applied potentials and on the other hand by virtue of the multiplication produced by the microchannel plate. This property is utilized in many devices for viewing scenes having low levels of illumination such as night scenes in particular.

The expedient adopted in the prior art for overcoming the drawbacks indicated in the foregoing consisted in utilizing the distribution of potentials in the different electrodes and especially those of the transfer section located between the photocathode and the microchannel plate, the effect of this distribution being to prevent the ions produced within the microchannels from reaching the photocathode in large numbers.

Figure 2:
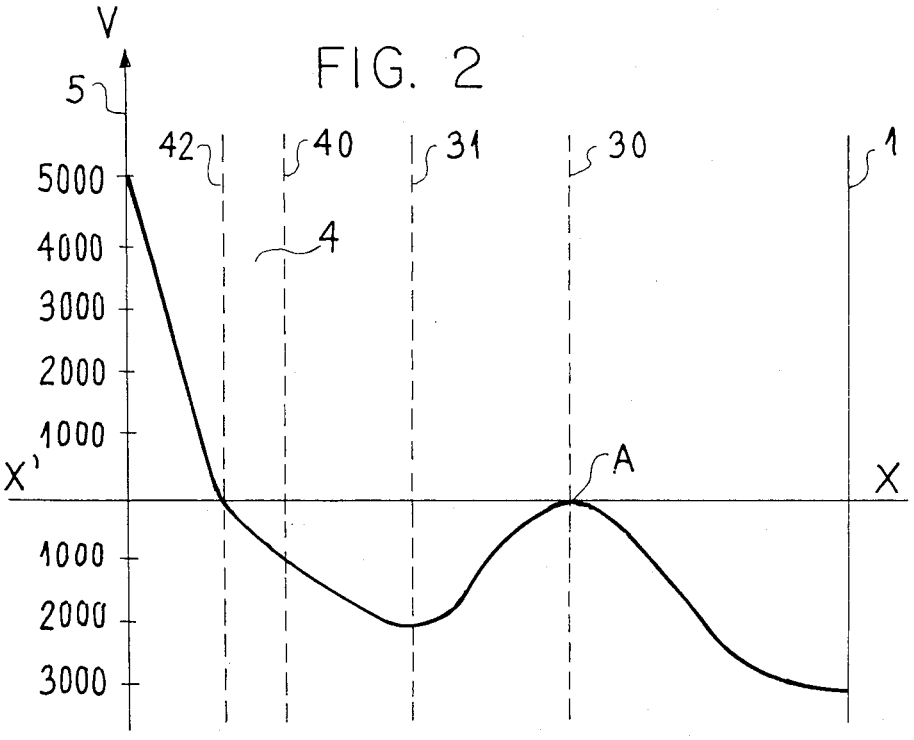
FIG. 2 represents the distribution of potentials along the axis within a tube of the type shown in the preceding figure.

The diagram of FIG. 2 gives one of the most common examples of distribution of potentials within an intensifier tube of the type described; the reference numerals serve in this case to designate the mean levels of the electrodes of the preceding figure.

The electrons emitted by the photocathode are first accelerated and then slightly slowed-down but reach the entrance of the microchannels with a positive acceleration. On the other hand, the ions which are produced within said microchannels and the potential of which is equal at a maximum to the potential of the electron exit face 42 of the microchannel plate 4 are slowed-down between the opposite electron entrance face 40 of said plate and the focusing electrode 30. Said ions do not have sufficient energy to reach this electrode and are consequently returned by this latter to the microchannel plate, towards the walls of the enclosure 20 and more particularly towards the correcting electrode 31 which has the most negative potential. The ions therefore fail to pass beyond the crest A of the potential profile.

It is recalled that the function of the correcting electrode 31 is to ensure uniformity of the angle of incidence of the electrode beams on the microchannel plate with a view to providing a uniform gain and in order to reduce image distortion.

The arrangement just described has the advantage of preventing degradation of the photocathode by a part of the ions which are present within the tube. However, said arrangement does not limit the pressure rise which occurs within the tube as a result of appearance of said ions and which indirectly produces the same effects. In accordance with the invention and in order to limit this pressure rise, getter material is placed in those portions of the tube towards which the ions are preferentially directed and which are located within the last part of the path followed by the electrons, in particular on the correcting electrode 31 and on the surface of the focusing electrode 30 located opposite to the microchannel plate 4 of the example described. This operation is performed under conditions which will now be explained.

FIG. 3(*b*) shows one embodiment of the invention which is given by way of example and not in any limiting sense. FIG. 3(*a*), the left of FIG. 3(*b*) represents a half-section of a microchannel image intensifier of the prior art and FIG. 3*b* aligned to its right shows the other half-section of a tube which has been modified in accordance with the invention. FIG. 3(*b*) shows three possible modifications which may not be combined within one and the same tube in accordance with the invention.

On the other hand, in the event that the tube should contain a greater number of electrodes than that of the example, especially in its optical system, modifications such as those described could be applied to the different electrodes within the scope of the invention.

As shown in FIG. 3(*b*), the focusing electrode 30 is modified so as to permit the supply of electric current to a getter. Said focusing electrode is designed in two parts or elements 301 and 302; the getter 50 is placed between said two electrode elements which are advantageously bent-back in order to serve as shields for ensuring that the different constituent parts 21–24 of the insulating envelope 20 as well as the microchannel plate 4 at one end and the photocathode 1 at the other end are protected against evaporation in the case of a vaporizable getter consisting of tantalum, titanium, barium, and so on. The same arrangement can be adopted in the case of a nonvaporizable getter of the zirconium-aluminum oxide type, for example. In this case the getter is supplied between the two electrode elements and serves as an electrical connection for these latter by means of leads 51 and 52 shown in FIG. 3(*b*).

Similarly, another getter is placed at the level of the corresponding electrode 31, this electrode being also designed in two parts or elements 311 and 312 which are again preferentially bent-back for the same reasons. The getter is designated by the reference numeral 60 in FIG. 3(*b*) and its connecting-leads are designated by the references 61 and 62.

In some instances, provision is made in the prior art for a getter 80 which is housed at the level of the photocathode connection as shown in FIG. 3(*a*). In accordance with a widespread practice, this connection consists of a cup 70 welded to the entrance window 2. Said getter is supplied through the filler tube 90 via the passage 100. Furthermore, the photocathode which is located next to this connection is protected against evaporation of the getter by means of a screen 110. In contrast to the prior art, the present invention dispenses with the need for a getter of this type since it is placed at a point of the tube at which there is a low probability of ion formation. The cathode connection is thus simplified and its diameter is reduced with respect to the prior art, all other things being equal. The reduction thus achieved in overall radial dimensions of tubes constitutes an advantage of the invention.

Tubes of this type are also employed in medical radiology for reducing the intensity of X-ray irradiation, in which they are known as X-ray image intensifiers. In this case, the entrance window comprises a scintillator placed in front of the photocathode and applied against this latter.

Said tubes are also frequently incorporated in picture-taking systems which comprise a number of other tubes and are placed at various levels in such systems, their intended function being to increase the level of the output signal.

The invention is accordingly applicable to systems of the type just mentioned.

What is claimed is:

1. An image intensifier tube comprising (a) a vacuum enclosure including an entrance window (2) for receiving radiation and an exit window (6);

(b) a photocathode (1) inside said envelope at said entrance window for receiving said radiation and providing electrons into said tube in accordance with said received radiation;

(c) a luminescent scree (5) inside said envelope at said exit window for converting electrons into exiting visible radiation;

(d) means including at least one electrode (31) inside said envelope between said photocathode (1) and said luminescent screen (5) for directing said electrons toward said screen;

(e) a microchannel element (4) between said electrode and screen (5) and in proximity of said screen; said microchannel element receiving said accelerated electrons and multiplying their number which then impinge upon said screen; said element also generating undesirable ions which are attracted toward said electrode;

(f) a getter (60) positioned at said electrode for absorbing said undesirable ions, thereby reducing the quantity of generated ions inside the tube and thus extending the life of said tube.

2. A tube according to claim 1 wherein said electrode with said getter is at a negative electric potential (FIG. 2, 31) to attract said ions.

3. A tube according to claim 2 wherein said directing means includes another electrode (30) between said negative electric potential electrode (31) and said photocathode, said other electrode being at a more positive potential (FIG. 2, A) thus inhibiting the flow of ions towards the photocathode (1) and directing the ions toward said negative electric potential electrode.

4. A tube according to claim 3 wherein a second getter (50) is placed at said other electrode (30) at a side toward said negative electric potential electrode.

5. A tube according to claim 1 wherein said one electrode is in the form of two constituent elements (311, 312) electrically insulated with respect to each other and said getter (60) is mounted between said two constituent elements.

6. A tube according to claim 4 wherein said other electrode (30) is in the form of two constituent elements (301, 302) electrically insulated with respect to each other, and said second getter (50) is mounted (51, 52) between said two constituent elements.

7. A tube according to claim 2 wherein said one electrode (31) is a correcting electrode.

8. A tube according to claim 2 wherein said other electrode (30) is a focusing electrode.

9. A tube according to claim 5 wherein said constituent elements (311, 312) terminate in bent back portions within the interior of the tube.

10. A tube according to claim 6 wherein said constituent elements (301, 302) terminate in bent back portions within the interior of the tube.

* * * * *